United States Patent [19]

Beecroft

[11] 4,391,443

[45] Jul. 5, 1983

[54] EXERCISE APPARATUS

[76] Inventor: Julian B. Beecroft, Box 57, Port Hope, Ontario, Canada, L1A 3V9

[21] Appl. No.: 277,123

[22] Filed: Jun. 25, 1981

[51] Int. Cl.[3] ..... A63B 23/02

[52] U.S. Cl. ..... 272/145; 128/25 R

[58] Field of Search ..... 272/144, 145, 49, 146, 272/51, 50, 46, 48, 115; 128/25 R, 70, 24 R

[56] References Cited

U.S. PATENT DOCUMENTS

| | | | |
|---|---|---|---|
| 1,179,436 | 4/1916 | Kideney | 128/24 R |
| 2,054,402 | 9/1936 | Williams | 128/24 R |
| 3,083,037 | 3/1963 | Gordon | 272/49 X |
| 3,441,271 | 4/1969 | Palacios | 272/145 |
| 3,602,501 | 8/1971 | Garner | 272/145 |
| 3,709,488 | 1/1973 | Garner | 272/145 |
| 3,716,231 | 2/1973 | Martin | 272/144 |
| 4,109,909 | 8/1978 | Csutor | 272/146 |
| 4,113,250 | 9/1978 | Davis | 272/146 |

FOREIGN PATENT DOCUMENTS

| | | | |
|---|---|---|---|
| 925528 | 5/1973 | Canada | 172/144 |

*Primary Examiner*—Richard J. Johnson
*Attorney, Agent, or Firm*—Robert S. Smith

[57] ABSTRACT

An exercise apparatus which includes a ring shaped cushion member dimensioned and configured to freely allow a human torso to enter therein in generally axially aligned relationship and with clearance about at least a portion of the associated human torso. The apparatus includes structure for supporting the ring shaped cushion member for rotational movement about the axis thereof and structure for receiving the feet of a user disposed in axial spaced relationship from the ring shaped cushion member.

21 Claims, 23 Drawing Figures

60
61
60
60
64
62
63
62
60
64
62

EXERCISE APPARATUS

BACKGROUND OF THE INVENTION

The invention relates to exercise apparatus and particularly to apparatus intended to provide exercise for the torso as well as other parts of the human body. The prior art includes a wide variety of exercise apparatus. The increased awareness of the benefit of more exercise has brought public attention to such devices. Many of the prior art devices are intended to allow the user to exercise limited portions of the body. Many have utilized relatively heavy weights.

The prior art apparatus includes excercising apparatus such as that shown in U.S. Pat. Nos. 4,109,909; 4,113,250; 4,214,790; and 3,464,718. The apparatus described therein has not been wholly satisfactory, in part, because it has not completely exercised the torso and other portions of the body. It is desirable to exercise the torso about the entire circumferential extent as opposed to merely exercising the torso in a relatively limited direction of movement.

The incidence of medical problems associated with the back is indicated by the large number of Workmens Compensation claims and other injuries that are annually recorded.

Back problems begin from, at least, the following causes: a prior injury that was never given the opportunity or treatment needed for healing, self-imposed over stressing, fatigue persisting from restricted movement or from standing or sitting, lack of circulation from too little movement or from lowered general health, poor nutrition, a change in body shape and balance as a result of an occupational stance or a protective stance assumed because of pain, bad footwear and walking habits, no belief in recovery or psychological unwillingness to acknowledge an ailment which has become a convenient escape, excess body weight, and lack of exercise.

It is of course well known to skiers and other athletes that the incidence of physical injury is substantially reduced among those who have conditioned their bodies by adequate exercise. An unused function tends to wither. If the head is never turned more than ten degrees to the right or left, then the time will come when it can not be turned more than that. A ballet dancer in a spin turns the head half-way around in relation to the upper body and at a rate somewhere between seventy five and a hundred times a minute. An unpracticed person of sedentary habits might attempt to rotate his head in this manner one or two times and probably severely strain some ligaments. The dancer is able to perform without danger of injury because of conditioning by long periods of practice.

When seeking an increase in well being, healing or development it is apparent that interrelated aspects are involved. These aspects include: body chemistry and nutrition, exercise (which stimulates and intensifies other functions), breathing, and sleeping. When the first three aspects are in good order, then sleep normally looks after itself in time and/or intensity as does similarly, breathing and the rate thereof.

Muscles exercised slowly against a resistance that is progressively increased at each exercise period will develop rapidly in size but not necessarily in endurance. The endurance developed will amount to what is practiced. Large muscles developed by slow movement and heavy resistance without much repetition offer little if anything toward vitality, life potential or good health.

They are as easily bruised as smaller muscles. They become burdensome and limit the flexibility of the body. Muscles exercised in rapid motion will tend to remain smaller or diminish in size while acquiring more power or endurance.

Once a development of the muscles is acquired, their capacity will remain close to the developed limits by using or exercising to those developed limits perhaps as infrequently as once a week or even every two weeks. The performance of any one set of muscles is dependent upon the whole body condition.

Cartilage and ligaments are not developed as quickly as muscles. The power of muscles may be noticeably increased in a few weeks time whereas a corresponding development of the cartilage and ligaments may take six times longer. In this sense, the enthusiastic muscle-builder and would-be weight lifter may develop muscular power and undertake efforts that will overstress his spinal discs and ligaments before they are developed sufficiently to accept the relatively large forces frequently encountered in weight lifting.

The objects of the invention are

1. To enable activation of the spine throughout its three hundred and sixty degree circumferential range of movement, in a manner to stretch and toughen cartilage and ligaments.
2. To assist in increasing muscle flexibility and range of movement in the trunk and upper body.
3. To assist in strengthening of muscles in certain of their ranges of movement made possible by rotation and inclination.
4. To do all of the foregoing under the user's own control, using only gravity forces.
5. To allow for hand held weight-loading if it is desirable in the case of developing muscle size, since hand held weights may be dropped safely to the floor if the user senses overstress.
6. To do all of the foregoing with lessened compressive end loading on the spinal column.
7. To provide apparatus that is safe to use, and particularly will allow the user to relax safely at any moment.
8. To provide apparatus that may assist in waist line reduction and general body building.

SUMMARY OF THE INVENTION

The foregoing objects and other objects and advantages which shall become apparent from the detailed description of the preferred embodiment are attained in an apparatus which includes means for mounting a means for receiving the feet of a user which may allow relative axial movement of the means for receiving with respect to the ring shaped cushion member. The means mounting the means for receiving may include means for positioning the means for mounting in a plurality of discrete positions.

At least some of the discrete positions may be disposed in spaced relationship from the axis of the ring shaped cushion member. The means for supporting the ring shaped member for rotational movement about the axis thereof may include means for varying the inclination thereof. The means for receiving the feet of the user may include shoe like members and the shoe like members may include a depending plate shaped member.

In some forms of the invention the plate shaped member includes a bore and the means for receiving the feet includes a pivot bar having axial extremities dimensioned and configured for engaging the bore.

The means for supporting the ring shaped cushion member may also include first and second stub axles and generally vertical upright members cooperating therewith. The upright members may include means for varying the elevation thereof. The means for varying the elevation of the cushion shaped member may include first and second sets of bevel gears and an electric motor with worm gear reduction.

BRIEF DESCRIPTION OF THE DRAWING

The invention will be better understood by reference to the accompanying drawings in which.

DESCRIPTION OF THE PREFERRED EMBODIMENT

Figure 1:
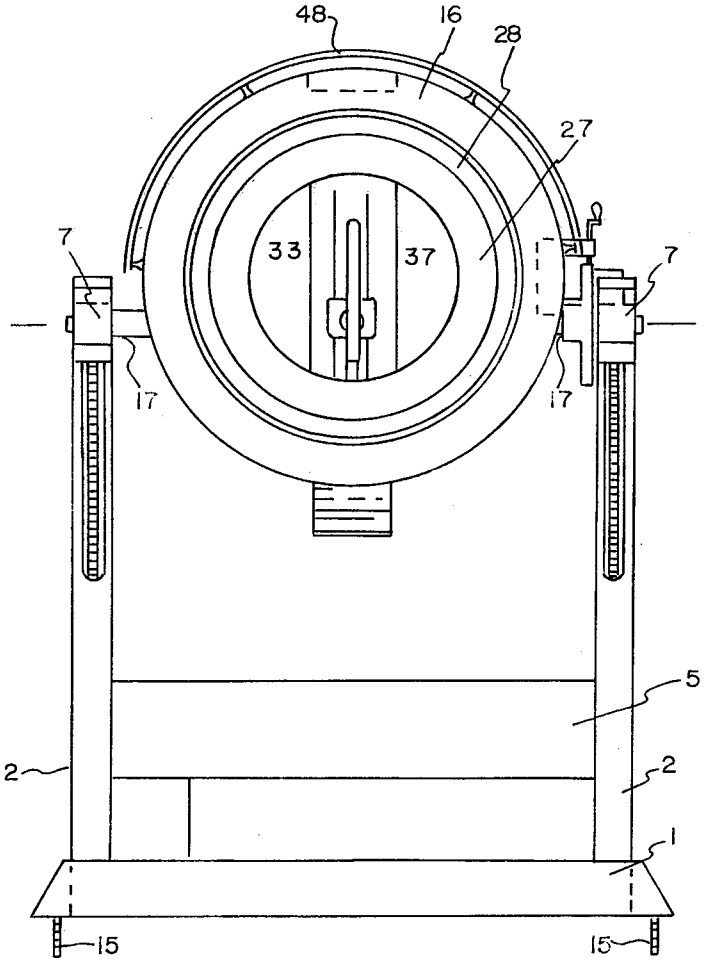
FIG. 1 is a front elevational view of the apparatus in accordance with the invention.
Figure 2:
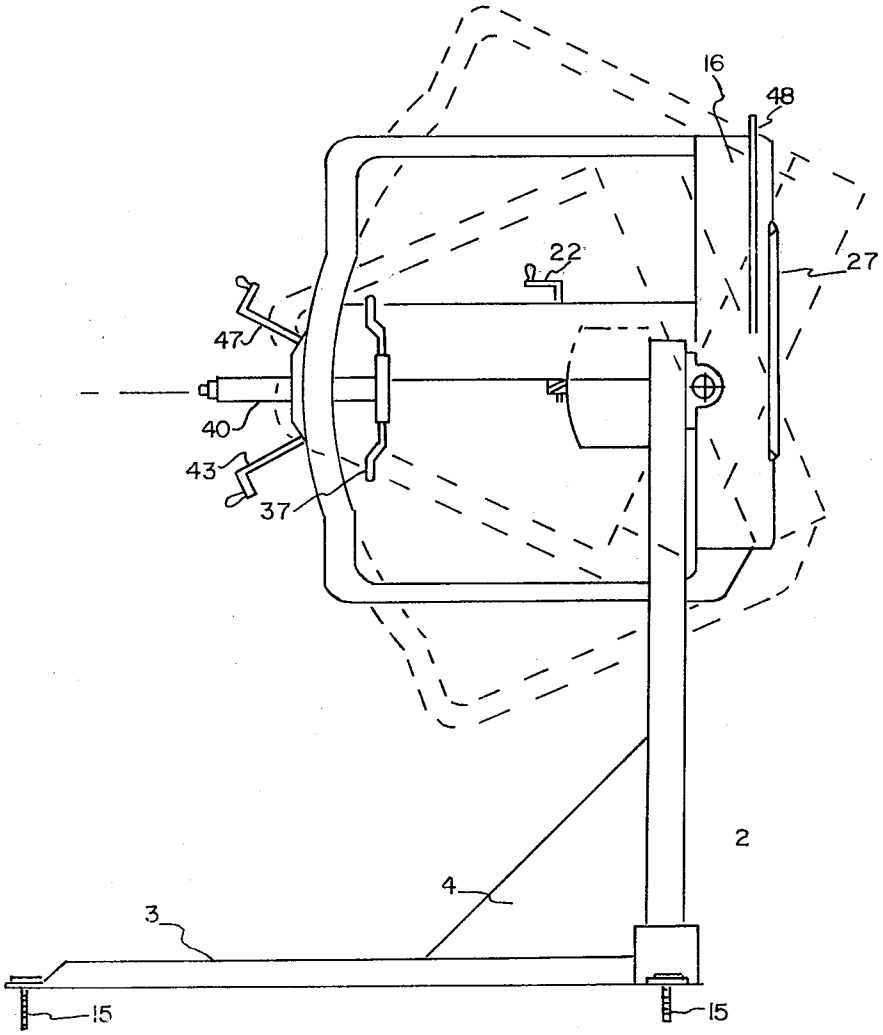
FIG. 2 is a side elevational view of the apparatus in accordance with the invention showing, in phantom, alternative positions of the apparatus.
Figure 3:
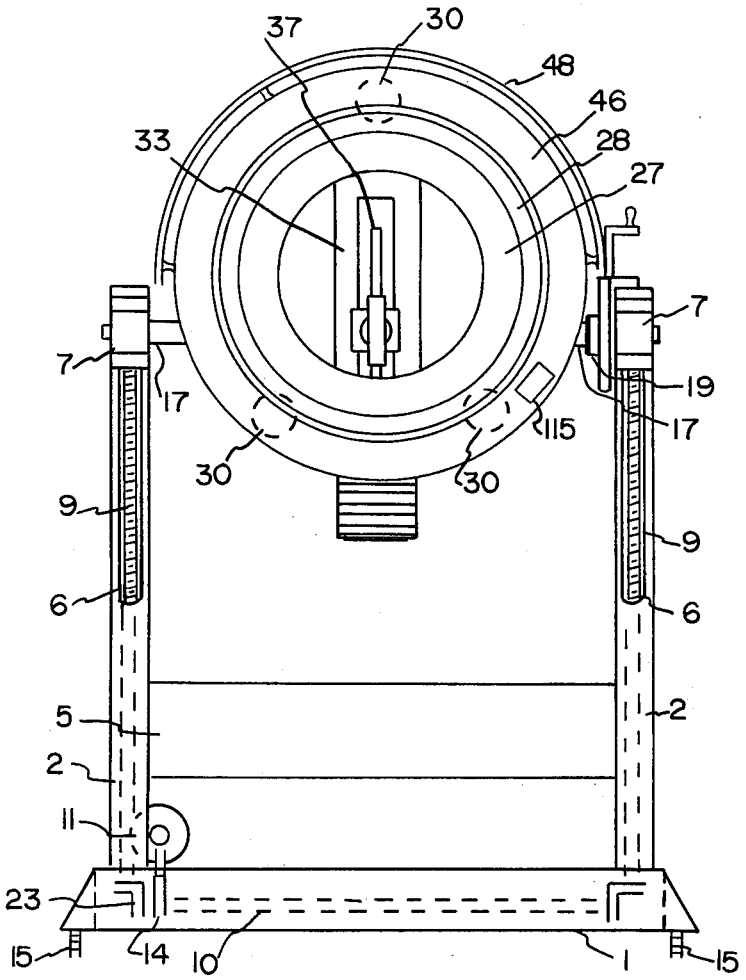
FIG. 3 is another front elevational view similar to FIG. 1, illustrating various aspects of the structure in accordance with the invention in greater detail.

Referring now to FIGS. 1–5 there is shown exercise apparatus in accordance with one form of the invention which includes a ring like cushion 27 of urethane or equivalent material having an inner circumference, in the preferred embodiment, of approximately sixty inches. The foam has a thickness of approximately eight to ten inches and is molded within or attached to a rigid circular rim 28, which may be manufactured of steel. The manufacture of the rim 28 may be accomplished by spinning with channeling and flanging. This will ordinarily be sturdy enough to ensure its circularity under working conditions. The channeling may provide a trackway 29 (shown in FIG. 5) about the circumferential extent thereof for rollers 30, which are best seen in FIG. 3. For various applications it may be desirable to provide a relatively wide trackway 29 in the rim 28 to cooperate with relatively wide urethane based or rubber rollers in place of the rollers 30 illustrated. Such embodiments would be quieter than the rollers 30 which are relatively narrow based. The rollers 30 may be manufactured of Nylon. The housing 16 is provided with openings (not shown) to allow for adjustment of the rollers 30 or for removal when it is desirable to dismount the cushion 27 and ring 28 assembly. The housing 16 is pivoted at each side on two upright frame members 2, 2. The manner of mounting is substantially the same as commonly used mirror mounting stands. The floor frame 3 is secured to the frame members 2, 2. Pivot bearings 7 are provided in each frame member 2, 2 for supporting the housing assembly 16. The pivot bearings 7, 7 cooperate with stub shafts 17, 17 at each side of the housing 16. This structure permits tilting of the housing 16 from a generally horizontal position. Various alternative inclinations are shown in FIGS. 13–17 which will be described hereafter.

The person using the apparatus positions his body within the cushion ring 27 and lies within and through the cushion ring 27. The housing 16 has a greater axial dimension ordinarily than the cushion ring 27. The rim 28 with its trackway 29 and cushion 27 is, of course, rotatable on the rollers 30. The feet of the user are attached by means of special boot 60 (to be described in further detail) to a swivel bar 37. Structure is provided for adjustment of the distance from the swivel bar 37 to the cushion ring 27, in part, to accommodate users of different heights. Structure is also provided for adjusting the angular relationship of the swivel bar 37 to the surface supporting the user on the cushion ring 27. When the user is poised as described he may rotate his body freely and the cushion ring 27 will rotate.

The term "turning axis" of the user's body will be used herein to refer to an imaginary line drawn from the center of a foot bar 37 at the feet of the user's body to the body's turning center at the pelvis. If the upper body weight of the user is kept below this imaginary line no rotation of the cushion ring 27 will take place. The user may relax generally as necessary to hold the position in which he selects to rest. In the face downward position he may relax quite completely. Any raising of the body weight above this "turning axis" will result in rotation of the cushion ring 27 in a direction according to the side to which the weight is moved. Rotation is at all times under the control of the user.

The main supporting frame includes a horizontal cross tube 1 disposed at floor level. The upright tubes or frame members 2, 2 rise therefrom at each side. Gussets 4, 4 extend, between the uprights 2 and the floor members 3 along with a stiffener 5, to give the required rigidity to the uprights 2, 2. Ordinarily the cross tube 1, the uprights 2 and the stiffener 5 are permanently joined to each other to maximize the rigidity. For some applications however, floor members 3 and the gussets 4 may be fastened by bolts to each other so that the apparatus may be stored or shipped more easily.

Figure 11:
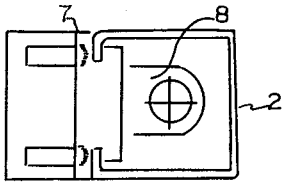
FIGS. 10, 11 and 12 are fragmentary views of a portion of the upright or frame in greater detail.
Figure 10:
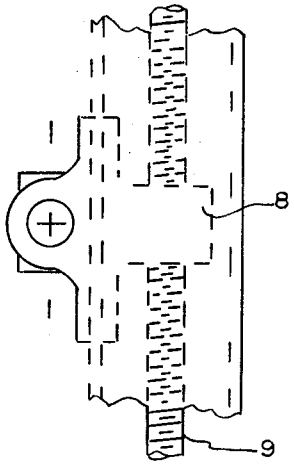
Figure 12:
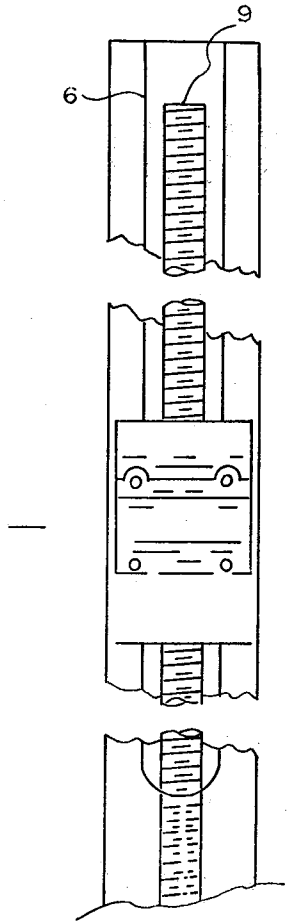

The upright tubes or frame members 2 are provided with a slot 6 which extends along an axial portion thereof. This structure is shown in greater detail in FIGS. 10–12. The slot 6 forms a guide for the pivot bearing 7 which is grooved to cooperate therewith. A portion of the pivot bearing 7 indicated by the numeral 8 is internally threaded to engage with a threaded shaft 9 which extends in generally axially aligned relationship with each frame member 2. It will be seen from FIG. 10, 11, and 12 how the vertical position of the pivot bearing 7 is altered by rotation of the threaded shafts 9 disposed in each frame member 2.

Figure 4:
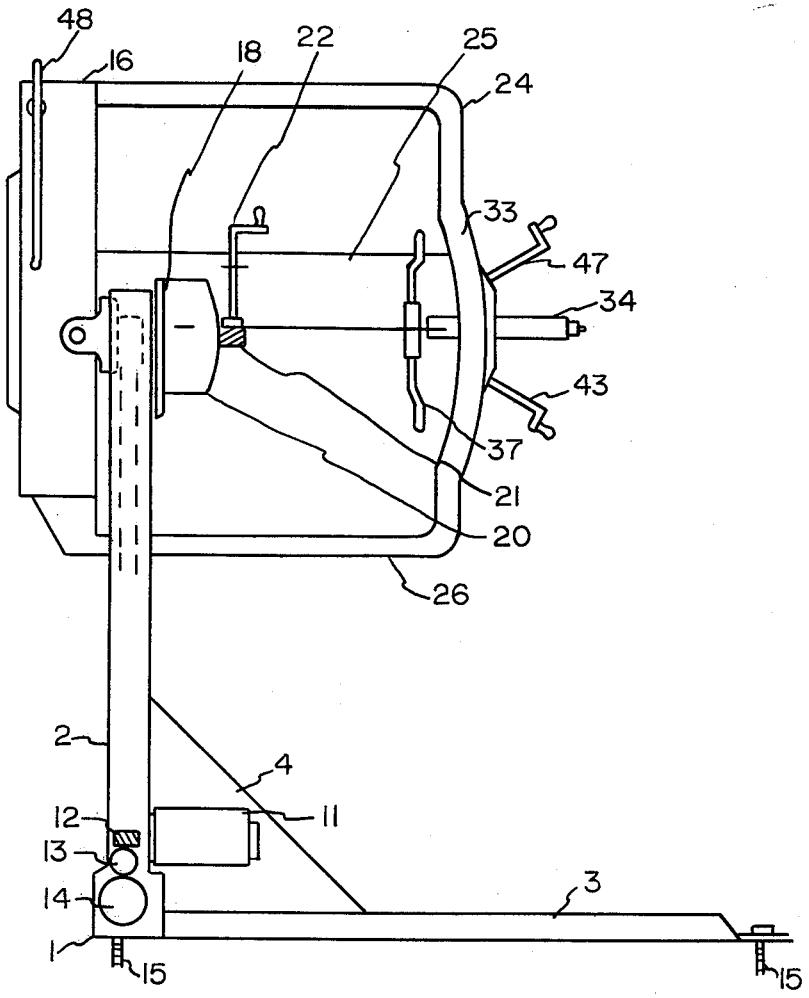
FIG. 4 is another side view elevational view similar to FIG. 1 illustrating the structure in greater detail.

Referring particularly now to FIGS. 3 and 4, there is shown a horizontal cross shaft 10 within the cross tube 1. The cross shaft 10 may be driven by an electric motor 11 having a worm gear output which drives a transfer gear 13 which in turn drives the gear 14 fixed to the cross shaft 10. Sets of bevel gears 23 at each end of the cross shaft 10 drive the upright shafts 9, 9 to raise or lower the housing assembly 16, with its attachments, to various levels suitable to the user's requirements for the exercises being undertaken. Removable end plates (not shown) in the cross tube 1 allow for the assembly of bevel gears. Openings (not shown) with covers (not shown) may be provided in the cross tube 1 for some applications.

Ordinarily the floor members 3 will be secured to the floor by means of anchor bolts such as 15.

Referring particularly to FIGS. 3 and 4, the housing 16 is shown to have stub shafts 17, 17 at each side thereof for engagement with the pivot bearings 7, 7. The tilting of the housing 16 is accomplished, as shown in partial schematic in FIG. 4, by a toothed sector gear 20 having a hub portion 19 which fits over the stub shaft 17. This mechanism is also visible in FIG. 3 at the right hand side thereof. A plate 18 rides against the rear face of the upright tube or frame member 2 in order to prevent the said mechanism from rotating. A worm gear 21 operable by a crank 22 is fixed to a frame member 25 which extends from the rear side of the housing 16. The range of possible tilt positions is indicated by the phantom lines of FIG. 2.

A snubbing device 115 (shown schematically in FIG. 3) is provided to limit or in come cases prevent reciprocal rotation or pendulum action of the cushion ring 27 because of the user's off center weight. The snubbing device 115 adjusts the rate at which the cushion ring will turn in response to the user's body movement. In some applications it may be desirable to employ a snubbing device 115 which includes a variable resistance to turning. The snubbing structure may be coupled to one or both of the lower rollers 30 illustrated in the FIG. 3. For those embodiments of the invention in which the rollers 30 are coupled together by a belt or chain, the snubbing means may be coupled to only one of the rollers 30. In another embodiment, a link chain is attached circumferentially to the rim 28 and a small sprocket in engagement therewith drives the snubbing device 115 which may utilize a relatively small hydraulic vane pump having open clearances, reservoir and a flow control in a closed loop circuit. In other embodiments the snubbing device may be frictional, electric, or magnetic. It will be understood that the snubbing device may be locked so that the ring will not turn from the position illustrated in FIGS. 3 and 4. Manual controls have been described for all positioning except raising and lowering of the housing 16 which is done by an electric motor with a reduction gearing. An attendant is required therefore to make adjustments to the satisfaction and the comfort of the user.

Figure 14:
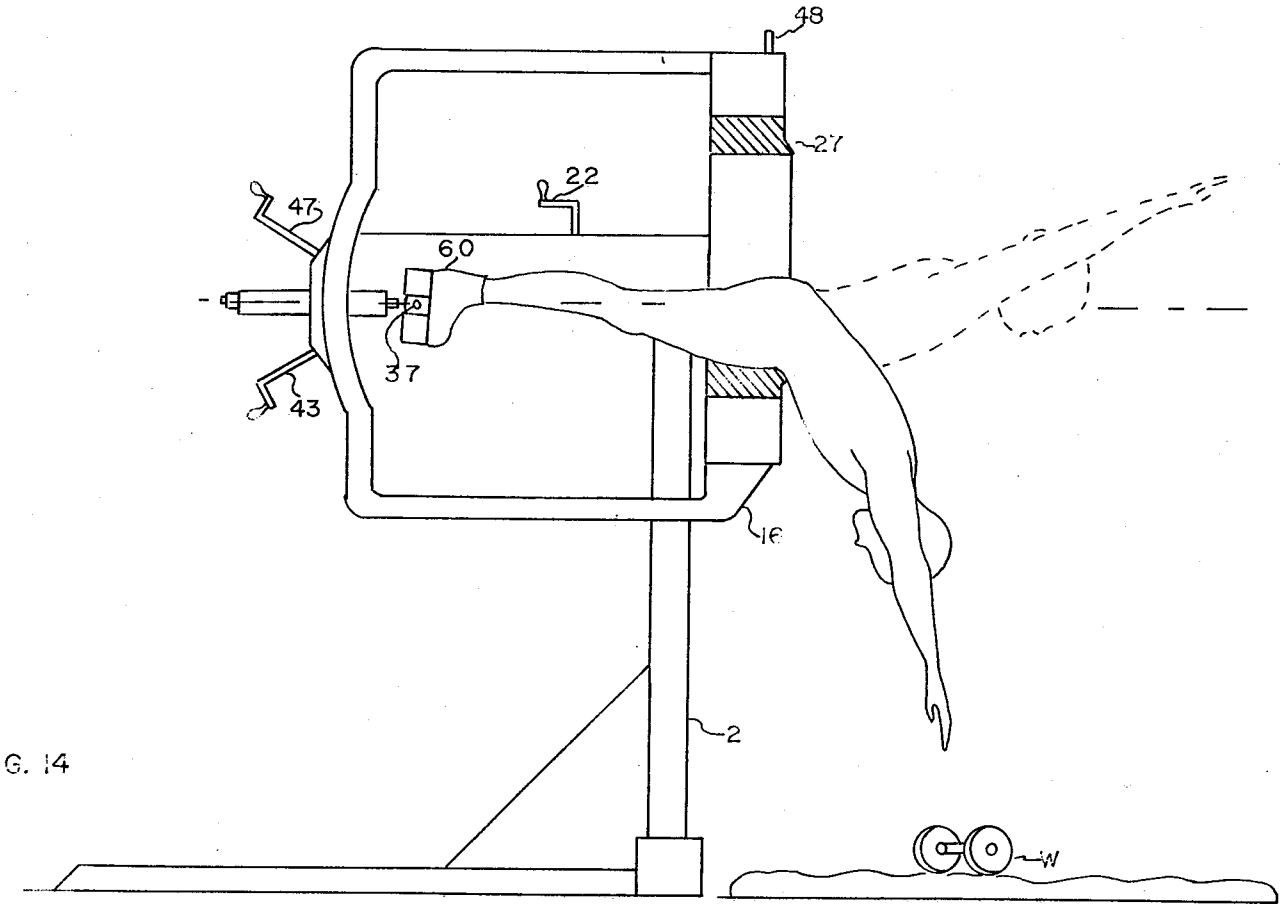

While using the apparatus in accordance with the invention, the easiest position to find is that shown in FIG. 14, which is face downward and relaxed. Controls placed on the bottom of the frame 16 may easily be reached in this position. An adjusting screw (not shown) accessible here controls the snubbing system and thus the rate of response of the cushion ring 27 to the turning of the user's body.

In other forms of the invention (not shown) in which all of the controls are electrified, switches are placed under the frame 16 to give the user full control over elevation and inclination in either direction. Switches for this purpose are limit switches having actuators made of close wound spring which stick out like "feelers" or "antennae".

A push button panel (not shown) on one of the uprights 2 is accessible to the user as well as an attendant.

The handrail 48 will, in the absence of an attendant or failure of electric power, permit the user to disengage himself and leave the apparatus.

Figure 7:
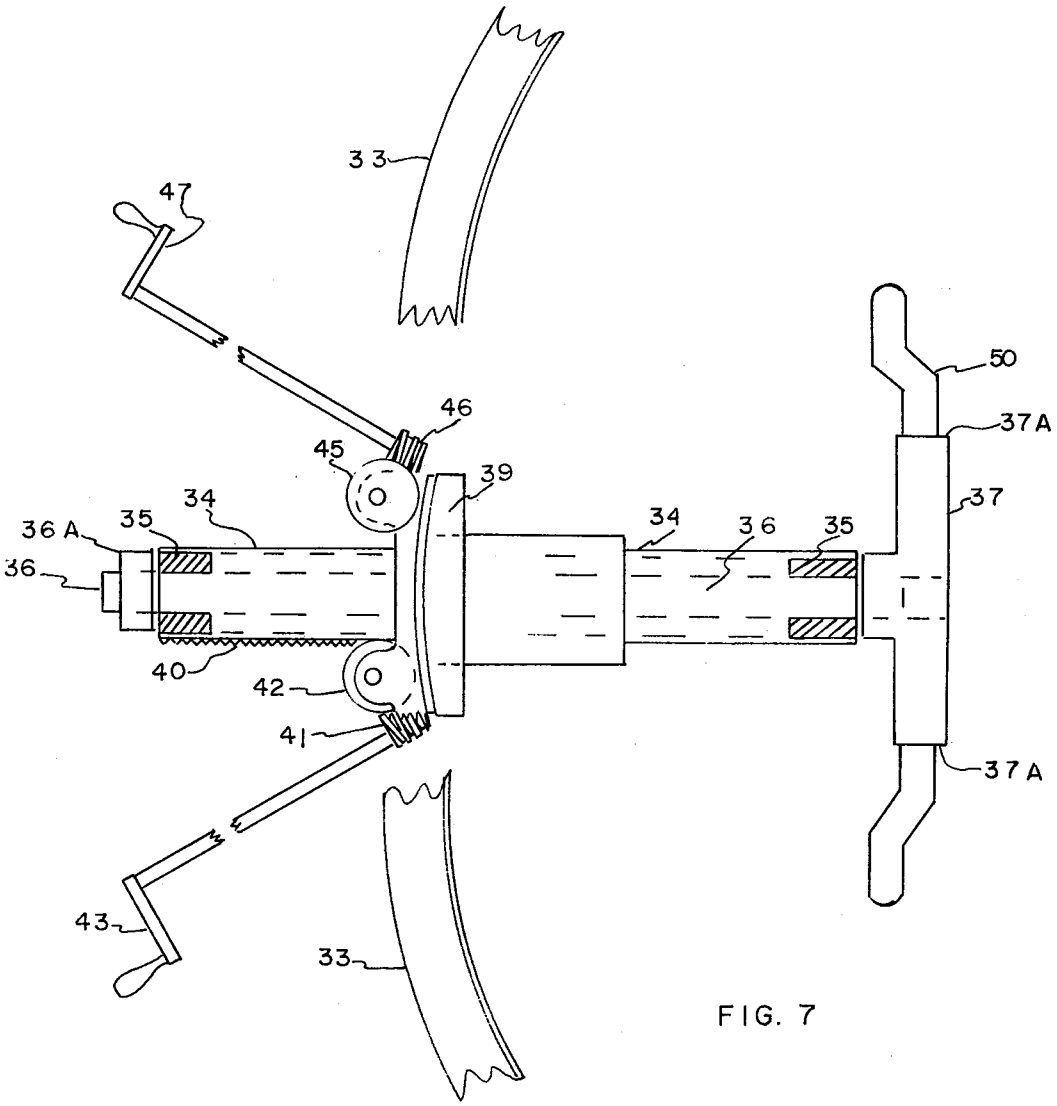
FIG. 7 is a fragmentary side elevational view of the apparatus illustrated in FIG. 6.
Figure 5:
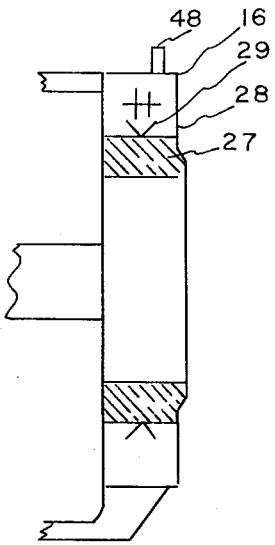
FIG. 5 is a fragmentary sectional view of a portion of the apparatus in FIGS. 1–4.

Referring particularly now to FIGS. 4 and 7 the foot bar swivel 37 is shown. A crank member 43 adjusts the swivel bar 37 closer to or farther from the cushion ring 27. The crank 47 raises or lowers and adjusts the angle of the swivel bar 37 in relation to the axis of the cushion ring 27.

Figure 6:
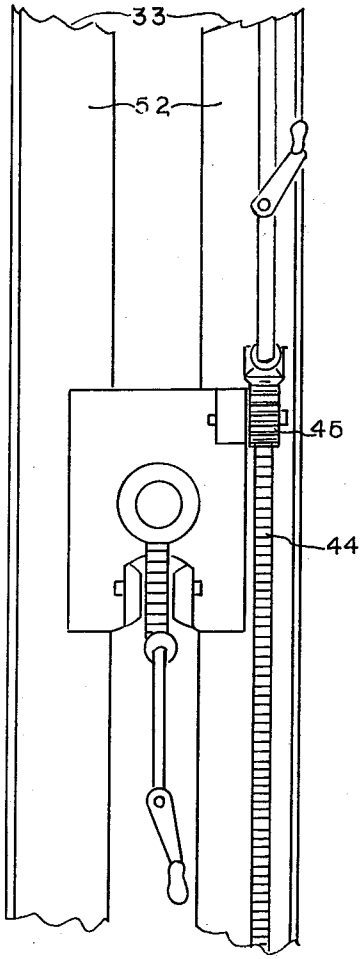
FIG. 6 is a partial elevational view of the slide member which supports the swivel bar 37.
Figures 8A, 8B, 8C, 8D:
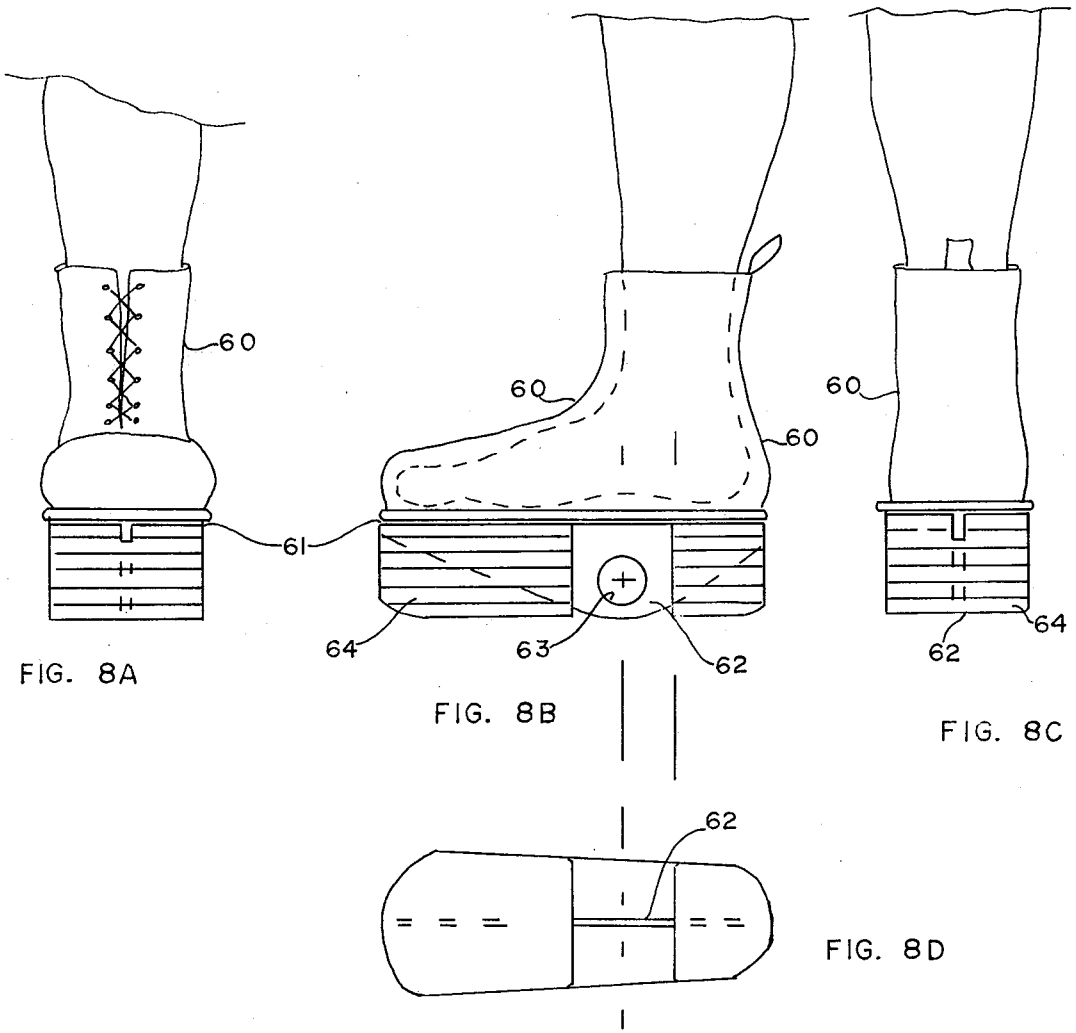
FIGS. 8*a*–8*d* are views of a boot having a steel plate fastened in a manner of a skate and which is used in the apparatus in accordance with the invention.

Three tubular frame members 24, 25, 26 extend rearward from the housing 16, as best seen in FIG. 4. The top tube 24, the bottom tube 26 and the side tube 25 support a curved slide 33 which is further illustrated in FIGS. 6 and 7. The side tube 25 turns inwardly to meet the side of the curved slide 33 and support it along the top and bottom tubes 24, 26 which meet and are fastened to the ends of the slide 33. Ordinarily the slide 33 will be a channel like member to provide additional stiffness. The slide 33 ordinarily will have a radius and more specifically will have a center of curvature which is disposed along the center line of the stub shafts 17, 17. The slide 33 is provided with a center slot 52 which accommodates a mounting block 39 which is dimensioned to move up and down within the center slot 52. Movement of the mounting block 39 is effected by a rack 44 which is attached to the slide 33, a gear 45 carried on the mounting block 39 and a worm gear 46 turned by a crank 47.

The mounting block 39 accommodates a cylindrical casing 34 which has a rack 40 on one side so that it may be moved back and forth through the mounting block 39 by means of a gear 42 turned by a worm gear 41 having a crank 43. The cylindrical casing 34 has a bearing 35 at each end for cooperation with a shaft 36 which may turn freely therein. The swivel or foot bar 37 is securely welded or attached to the shaft 36. A nut 36A carried on the left end (as viewed in FIG. 7) prevents movement of the shaft 36 axially.

Figure 9B:
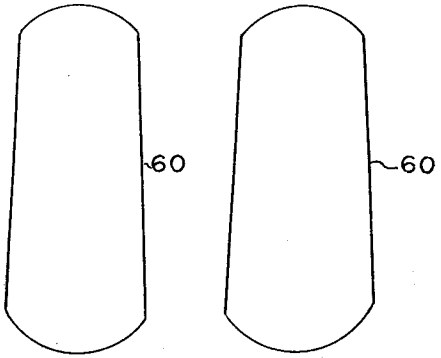
FIG. 9 is a view illustrating the manner of cooperation between the foot bar illustrated in FIGS. 1–4 and the boots illustrated in FIGS. 8A–8D, wherein the phantom view illustrates the manner of angling the boot in order to place it on the footbar.
Figure 9:
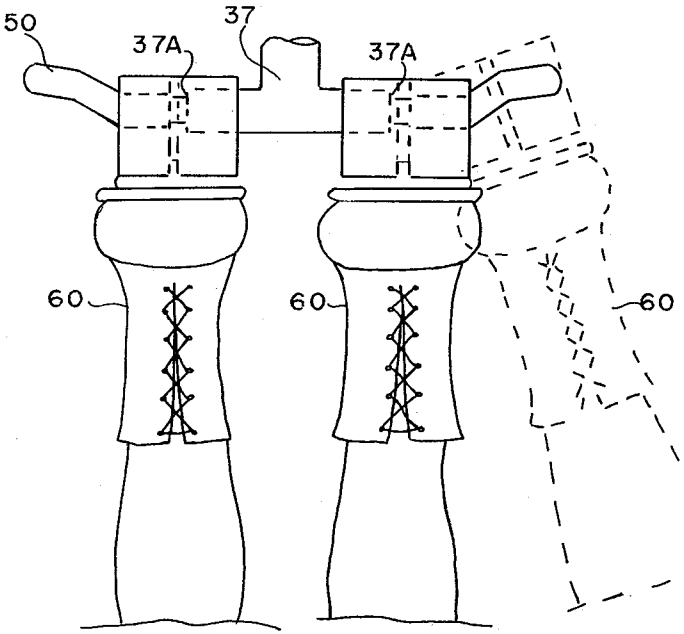

Referring particularly now to FIGS. 8A–8D and FIG. 9, the boots 60 to be worn while exercising should be substantially as strong as a light skating boot. When laced there should be no possibility of the foot being withdrawn. The boot 60 will ordinarily have a steel plate section 62 fastened with substantially the same orientation as the skating boot. The plate 62 will ordinarily have a plate 61 fixed thereto, in perpendicular relationship, and which will be fastened securely to the bottom of the boot 60. The plate 62 will be provided with a hole or bore 63 which is dimensioned to pass over the relatively small diameter 50 of the foot or swivel bar 37 which is best seen in FIG. 9. The phantom view in that Figure illustrates the manner of connection of the plate 62 to the swivel bar 37. A shoulder 37A is disposed on each leg of the pivot bar 37 so that the user may know when his feet are equidistantly spaced from the rotational center of the swivel bar 37.

Figure 15:
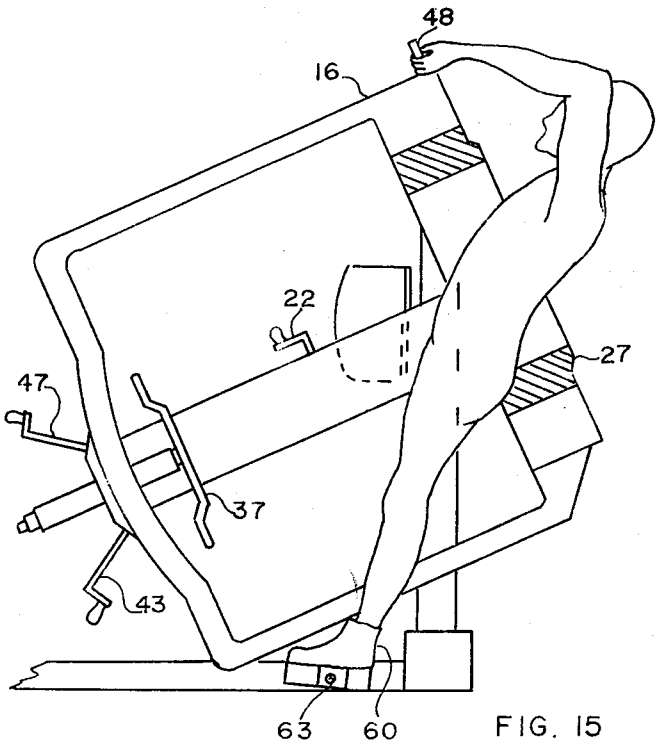
FIGS. 14, 15, 16 and 17 are simplified views of the apparatus illustrated in FIGS. 1–4 and showing various manners of cooperation with a human torso.
Figure 13:
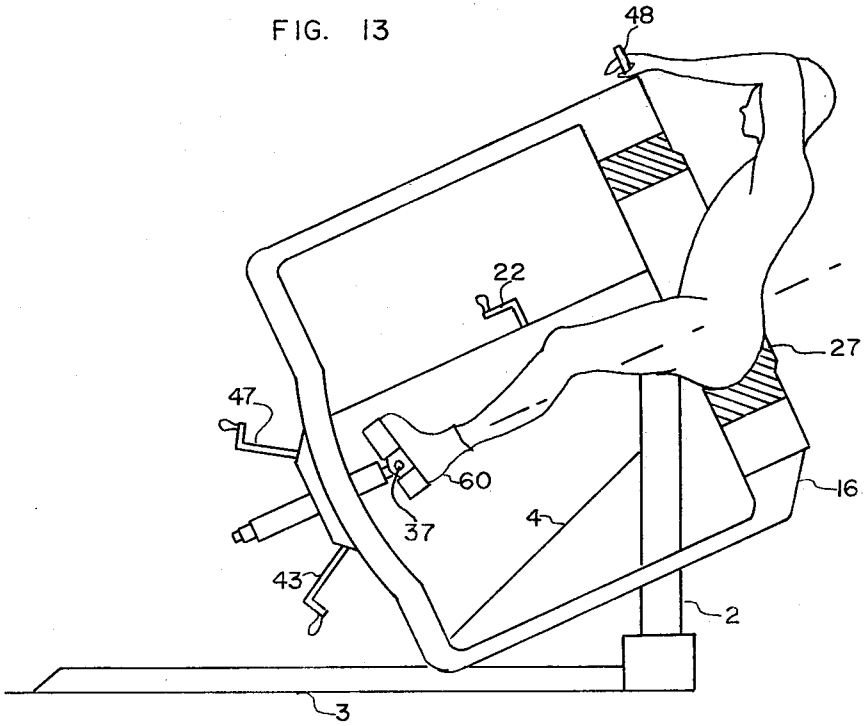
FIG. 13 is a simplified view illustrating one position of the apparatus illustrated in FIGS. 1–4 and the manner of cooperation of the human torso therewith.

The general manner of utilization of the apparatus in accordance with the invention is best illustrated in FIGS. 13–17. In FIG. 15 there is shown the housing 16 with the cushion ring 27 disposed in a lowered position and set at an angle convenient for the user to enter. Referring to FIG. 13 there is shown the relationship of the cushion ring 27, housing 16 and the pivot bar 37 when the boots 60 have been engaged therewith.

In FIG. 14 the user is shown in a face down stable position. If the user's torso is raised to the position shown in phantom the cushion ring 27 will rotate.

Figure 16:
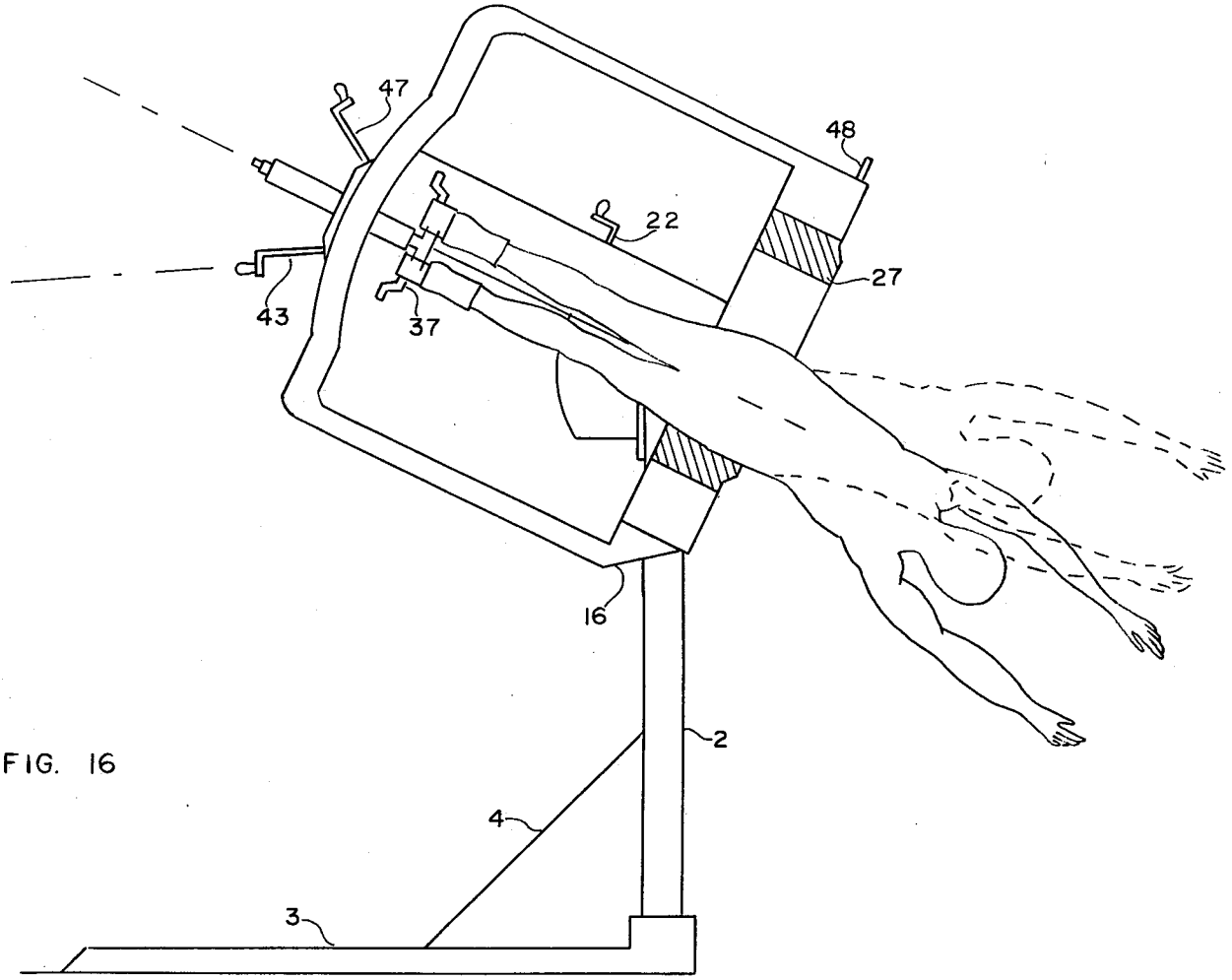
Figure 17:
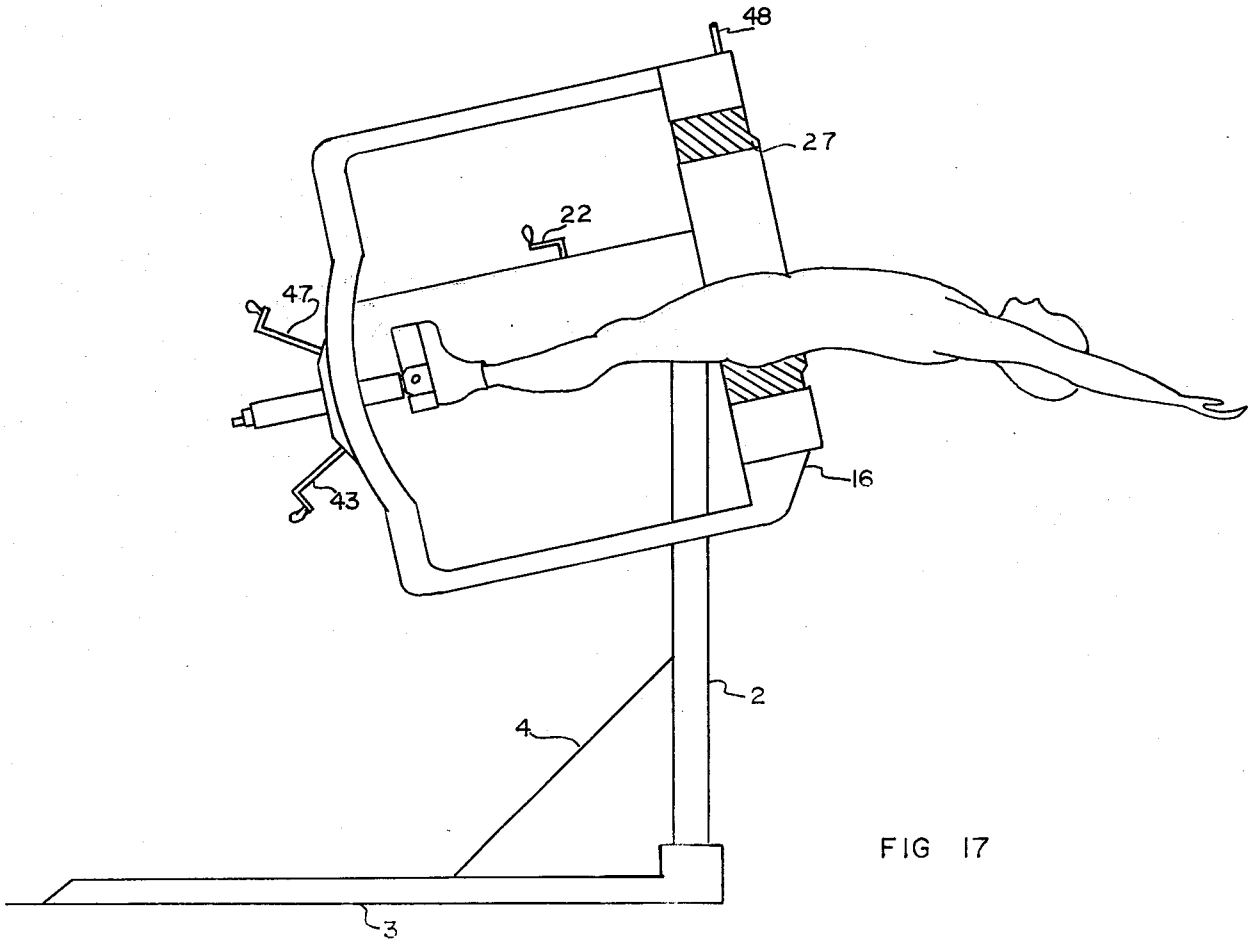

FIG. 15 illustrates a preliminary position of the user as he enters the apparatus and before he engages the boots 60 with the swivel bar 37. FIG. 16 illustrates a downward inclination of the frame 16 with the user bending sideways, and FIG. 17 illustrates an upward inclination of the frame 16.

In the apparatus so far described, the user is supported at the pelvis, with the feet attached to the swivel bar 37 while the upper part of the body, which is outside of the cushion ring 27, is unsupported mechanically and therefore dependent upon the user's own muscles for either movement toward or holding any positions which approach a horizontal position, unless of course he/she is totally relaxed. This apparatus is suitable for use by those who have well developed torsos such as athletes, dancers, or those who have a natural and normal development from an outdoor life.

The great majority of persons, including those who are sedentary, and those who are soft and oversize at the waist, are not capable of holding up their upper body in a generally horizontal position if the body is supported only at the feet and the pelvis. There are also those who may be in recovery from injury, operation, or illness, who may benefit from therapy or manipulative movement by means of the apparatus having rotational and bending limits calibrated and preset.

Figure 18:
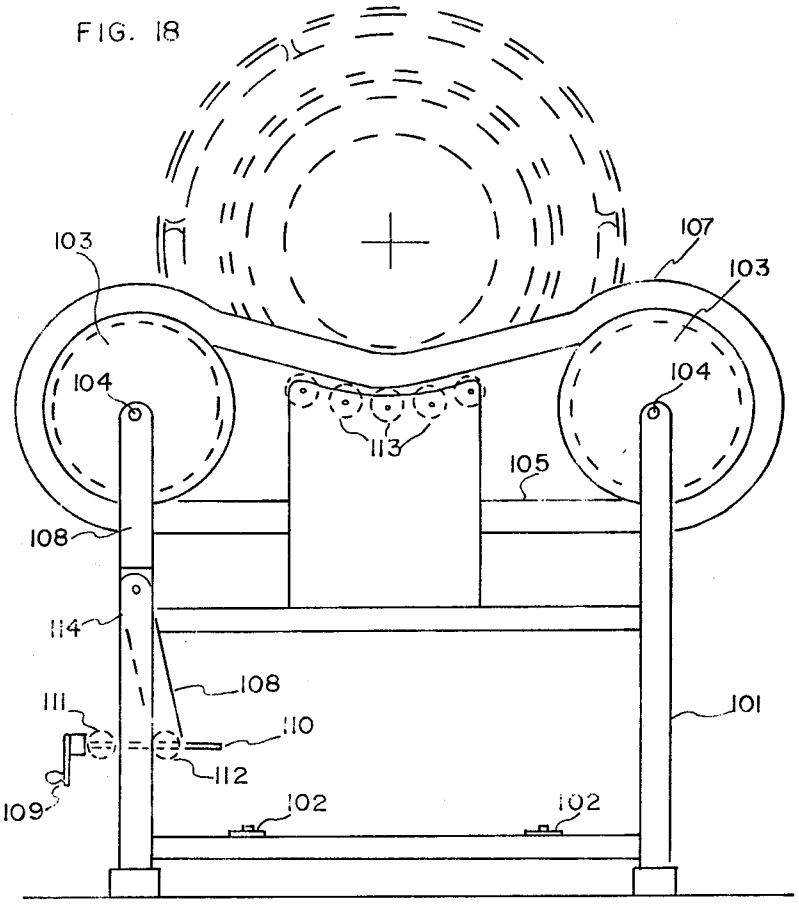
FIGS. 18 and 19 are respectively front and side elevational views of another embodiment of the invention.
Figure 19:
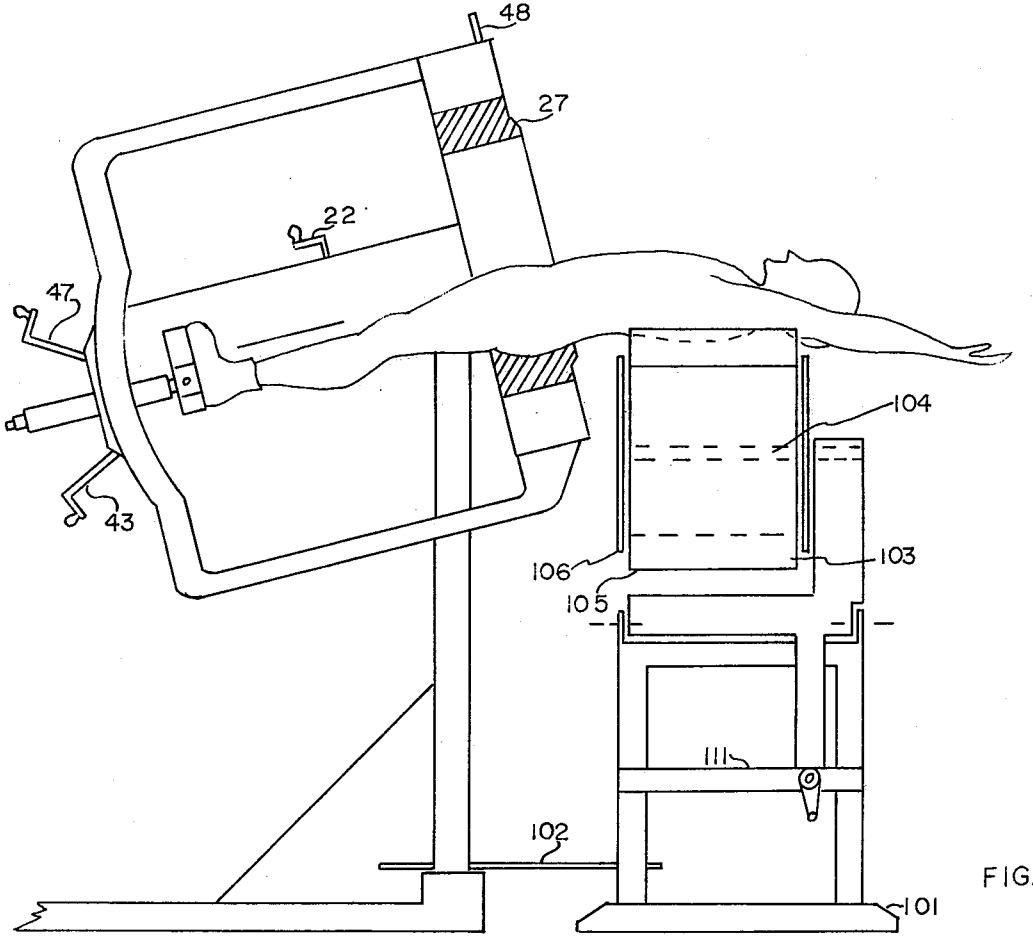

In order that less well developed persons may enjoy the benefits of the apparatus described above an auxiliary piece of apparatus is necessary. Referring now to FIGS. 18 and 19 this apparatus includes a frame 101 which rests on the floor. Two attached measuring bars 102 enable the frame to be suitably spaced from the main frame supporting the cushion ring 27. This is to enable a user to repeatedly adjust the apparatus to a calibrated spacing which he/she has determined to be comfortable. Two freely turning drums 103 are supported on two shafts 104 which are fixed to the frame 101. A belt of canvas 105 or some equivalent material extends around the drums which have end flanges 106 to prevent run off.

The belt 105 includes a lamination (not separately shown) of urethane foam cushion material of suitable density. The large diameter of the drums e.g. (18") enables a cushion of $3\frac{1}{2}$" thickness to flex around the drum 103. The cushion belt 105 when in working position gives support to the user's shoulder region and some support to the user's head.

Adjusting the distance from one drum 103 to another drum 103 controls the amount of depression of the belt 105 when the user's weight is disposed thereon. The depression is also affected by the freely turning rolls 113 placed under the belt 105 and extending the full width thereof. The belt 105 is adjusted to be less than taut when the user's weight is upon it. Ordinarily all of the rollers 113 and drums 103 are mounted on ball bearings (not shown) and the belt moves freely, and is responsive to any turning of the user.

The drums 103, 103 are carried on shafts 104 which are supported at one axial extremity only as best seen in FIG. 19. This construction is preferred so that the belt 103 may be easily removed or put back in place, since for some applications the belt may require occasional sanitizing.

One drum 103 is mounted on a frame 108 member which pivots on a pin 114. A crank 109 is coupled to a threaded shaft 110. The shaft 110 is fixed lengthwise at its mounting through a tube 111 which is fixed across the frame. The threaded portion of the shaft 110 engages a nut member (not shown) inside of the cylindrical end 112 of the frame 108.

It will best be seen that a wide variety of exercises may be performed by the user. Such exercises may include the use of relatively small weights, such as W illustrated in FIG. 14.

The apparatus in accordance with the invention enables the stretching and bending of the trunk of the user throughout 360 degrees. It permits prolonged exercise of this kind under comfortable conditions with the slope of the housing variable to suit the user's exercising program. When the slope is downward the compressive pressures upon the spinal discs of the user are greatly reduced.

The apparatus in accordance with the invention may be constructed using relatively simple manufacturing techniques which are commonly done in relatively unsophisticated machine and welding shops. This is true for substantially all of the apparatus with the exception of the ring 28 which is a circular sheet of metal which is rolled onto a form while spinning. The tooling for such spinning operations is probably the most significant tooling required. The urethane cushion ring 27 is preferably molded and ordinarily will be formed in a mold made of wood and epoxy faced to provide the external shape of the foam cushion 27. The mold (not shown) is made separable so that the part may be easily removed. Catalyzed materials are poured into the mold then closed until the forming is completed.

The invention has been described with reference to its illustrated preferred embodiment. Persons skilled in the art of constructing exercise apparatus may, upon exposure to the teachings herein, conceive variations in the mechanical development of the components therein. Such variations are deemed to be encompassed by the disclosure, the invention being delimited only by the appended claims.

Having thus described my invention I claim:

1. An exercise apparatus which comprises:

a ring shaped cushion member dimensioned and configured to freely allow a human torso to enter therein in generally axially aligned relationship and with clearance about at least a portion of the associated human torso;

means for supporting said ring shaped cushion member for rotational movement about the axis thereof, said means for supporting said ring shaped support member for rotational movement about the axis thereof including means for varying the inclination thereof, internal cushioning disposed about the internal surface of said ring shaped cushion member, said means for supporting said ring shaped cushion member for rotational movement about the axis thereof including a trackway, a plurality of rollers, and a snubbing apparatus for limiting rotational movement of said ring shaped cushion member;

means for receiving the feet of a user disposed in axially spaced relationship from said ring shaped cushion member, said means for receiving the feet of the user including shoe like members, said shoe like members include a depending plate shaped member, each of said plate shaped members including a bore, said means for receiving the feet including a pivot bar having axial extremities dimensioned and configured for engaging one of said bores;

said means for supporting said ring shaped cushion member including first and second stub axles and generally vertical upright support members cooperating therewith, said upright support members including means for varying the elevation thereof, said means for varying the elevation including first and second worm gears and electric motor drive means for driving said worm gears;

said means for receiving the feet of a user including a swivel bar, and means for mounting said means for receiving the feet of a user which allows relative axial movement of said means for receiving with respect to said ring shaped cushion member, said means for mounting said means for receiving includes means for positioning said means for mounting said means for receiving in a plurality of discrete positions, at least some of said discrete positions being disposed in radially spaced relationship from the axis of said ring shaped cushion members, said means for mounting said means for receiving the feet of a user allowing rotational movement; and further including an auxiliary support for the upper body of the user, said auxiliary support comprises an endless belt.

2. The apparatus as described in claim 1, wherein:

said endless belt is supported by a plurality of drums and rollers.

3. An exercise apparatus for use by a human being, which comprises:

a ring shaped cushion member, having an axis, dimensioned and configured to support one side of a human torso in generally axially aligned relationship with said cushion member and in shaped relationship to any other side of the associated human torso;

means for supporting said cushion member in a generally horizontal position for free rotational movement about the axis thereof, said cushion member being adapted to be moved rotationally only in response to forces imposed by the user; and means for receiving and securing the feet of a user disposed in axially spaced relationship from said ring shaped cushion member.

4. The apparatus as described in claim 3, wherein said apparatus further includes:

means for mounting said means for receiving the feet of a user which allows relative axial movement of said means for receiving to said ring shaped cushion member.

5. The apparatus as described in claim 4, wherein:

said means for mounting said means for receiving includes means for positioning said means for mounting said means for receiving in a plurality of discrete positions, at least some of said discrete positions being disposed in radially spaced relationship from the axis of said ring shaped cushion member.

6. The apparatus as described in claim 3, 4, or 5, wherein:

said cushion member is ring shaped, and the majority of the inner face of said ring shaped cushion member has a clearance about the associated human torso, said means for supporting said ring shaped cushion member for rotational movement about the axis thereof includes means for varying the inclination thereof.

7. The apparatus as described in claim 6, wherein:

said means for receiving the feet of the user includes shoe like members.

8. The apparatus as described in claim 7, wherein:

said shoe like members each include a depending plate shaped member.

9. The apparatus as described in claim 8, wherein:

each of said plate shaped members includes a bore and said means for receiving the feet of the user include a pivot bar having axial extremities dimensioned and configured for engaging one of said bores.

10. The apparatus as described in claim 6, wherein:

said means for supporting said ring shaped cushion member include first and second stub axles and generally vertical upright support members cooperating therewith.

11. The apparatus as described in claim 10, wherein:

said upright support members include means for varying the elevation thereof.

12. The apparatus as described in claim 11, wherein:

said means for varying the elevation includes first and second worm gears and electric motor drive means for driving said worm gears.

13. The apparatus as described in claims 3, 4 or 5 wherein:

said means for mounting said means for receiving the feet of a user allows rotational movement.

14. The apparatus as described in claim 5, further including:

internal cushioning disposed about the internal surface of said ring shaped cushion member.

15. The apparatus as described in claim 14, wherein:

means for supporting said ring shaped cushion member for rotational movement about the axis thereof includes a trackway.

16. The apparatus as described in claim 15, wherein:

said apparatus further includes a handrail disposed around a part of said means for supporting said ring shaped cushion member for rotational movement.

17. The apparatus as described in claim 16, wherein:

said means for supporting said ring shaped cushion member for rotational movement includes a plurality of rollers.

18. The apparatus as described in claim 5, wherein:

said means for receiving the feet of a user includes a swivel bar.

19. The apparatus as described in claim 5, further including:

a snubbing apparatus for limiting movement of said ring shaped cushion member in a rotational manner.

20. The apparatus as described in claim 19, further including:

an auxiliary support for the upper body of the user.

21. The apparatus as described in claim 20, wherein:

said auxiliary support comprises an endless belt.

* * * * *